United States Patent [19]

Erdösi et al.

[11] Patent Number: 4,977,686

[45] Date of Patent: Dec. 18, 1990

[54] METHOD FOR PROCESSING ROUGH TIMBER

[75] Inventors: György Erdösi; László Bálint; Péter Osváth, all of Budapest, Hungary

[73] Assignee: Top-Coop Idegenforgalmi és Vendéglátóipari Kisszövetkezet, Budapest, Hungary

[21] Appl. No.: 300,065

[22] PCT Filed: Apr. 20, 1988

[86] PCT No.: PCT/HU88/00023

§ 371 Date: Feb. 7, 1989

§ 102(e) Date: Feb. 7, 1989

[87] PCT Pub. No.: WO88/08780

PCT Pub. Date: Nov. 17, 1988

[30] Foreign Application Priority Data

May 4, 1987 [HU] Hungary ..... 1983/87

[51] Int. Cl.[5] ..... F26B 3/00

[52] U.S. Cl. ..... 34/9.5; 34/13.8

[58] Field of Search ..... 34/9.5, 9, 13.4, 13.8

[56] References Cited

U.S. PATENT DOCUMENTS 1,855,666 4/1932 Curtin ..... 34/9.5

2,500,954 3/1950 Loughborough ..... 34/9.5

*Primary Examiner*—Henry A. Bennet

*Attorney, Agent, or Firm*—Schweitzer Cornman & Gross

[57] ABSTRACT

The invention relates to a method for timber processing during which the wood, such as sawn wood that is prepared for seasoning is dried in a kiln in a manner known per se at a temperature of between about 40° C. and about 100° C., to a moisture content of not more than 30%.

Nitric acid is mixed with an aqueous solution an alkali earth metal salt, and this mixture is sprayed into the drying kiln at least once. The spray loosens the pectin of the fiber that blocks the evaporation of the moisture, while the alkali earth metal is being built into the wood fibers.

10 Claims, No Drawings

METHOD FOR PROCESSING ROUGH TIMBER

FIELD OF THE INVENTION

The present invention relates to a method for processing rough timber wherein the wood, such as sawn wood prepared for seasoning is dried in a kiln, at a temperature of between 40° C. and 100° C., to a moisture content of not more than 30%.

BACKGROUND OF THE INVENTION

The primary products of timber industry, such as various kinds of sawn timber, veneer, and wood waste, that are produced for further use, usually have a moisture content above the saturation limit of the fiber. In this state timber is not suitable for further processing or shaping, therefore the moisture content has to be reduced by natural or artificial drying to under the saturation limit of the fiber to the air-dry (12–18%) or the room-dry (6–12%) state. The rapid increase in industrial use of wood products and the need for producing components of room-dry state made it essential to accelerate the slow natural drying process that usually lasts for at least 2 to 5 years, by the use of various artificial drying methods.

The acceleration of the natural drying processes (temperature, wind, humidity) has not led in an unchanged form to a good result, therefore various methods have been developed to remove the moisture from the wood as quickly and carefully as possible. Nearly all these methods are based on modifications of the properties and parameters (temperature, speed of air current, pressure, humidity) of the surrounding air, except for high frequency drying in which drift of the moisture begins from the inside.

Known artificial drying methods include:

convection drying,
condensation drying,
vacuum drying,
high frequency drying, and
drying in hot oil.

The first three procedures are generally used in practice. Each of them is suitable for reaching the required degree of humidity by changing various parameters of time and space. Quick drying of "dry" timber, which is quick compared with natural drying, usually involves three main phases:

heating,
drying, and
compensation (and conditioning, cooling).

The moisture content of timber dried by the aforementioned methods can be adjusted to the required level, but

- macroscopic features and defects in the wood result in inaccuracy in the achieved value (usually in the order of 1–5%),
- wood undergoes different deformations during drying (e.g. bending, warping, splitting, of butt or pith, etc.) because of the accelerated reduction of moisture content,
- tensions of different types and scales emerge during drying and remain until processing when further bending and warping take place, and
- the effects of the changes in the surrounding humidity, the achieving of balance in the moisture content of the wood, and other changes in the humidity (e.g. moistening) have the result that the artificially dried material changes its shape and dimension to a larger extent than naturally dried material.

DESCRIPTION OF THE INVENTION

The object of the present invention is to eliminate the aforementioned deficiencies and to provide a drying method for timber with reduced deformation, and changes in shape and dimensions, and holding the remaining stresses and the duration of the drying to an acceptable minimum.

During the development of the method of the invention we relied on the known methods and combined them with chemical processes that have had significant effects but have not been used before. Therefore any drying technique (convection, condensation, or vacuum drying) can be used subject to the following considerations.

Accordingly the present invention is a timber processing method which comprises drying substantially unseasoned timber while spraying it at least once with a mixture of a mineral acid and an aqueous solution of an alkali earth metal salt, whereby the pectin of the wood fiber which normally blocks the evaporation moisture from therebetween will become loosened to permit evaporation of the water content of the wood, and said alkali earth metal is incorporated in the wood fiber.

By the process of the present invention the stiffened state of the pectin in the molecular structure of the timber material is loosened at the critical moment. This enables the internal moisture to reach the surface and to evaporate without problems and then the acidic alkali earth solution promotes the incorporation of the alkali earth metal into the fibers of the natural material.

Suitably nitric acid is mixed with a solution in distilled water of an alkali earth metal salt, and this mixture is sprayed at least once into the drying kiln. The spray loosens the pectin of the fiber that otherwise blocks the evaporation of the moisture, while the alkali earth metal is built into the fiber of the wood.

According to an embodiment of the invention, the mixture to be sprayed contains 42–48 mass % nitric acid, 42–48 mass % distilled water, a salt of an alkali earth metal, such as 4–16 mass % calcium chloride. The concentration of the nitric acid can suitably be from about 65% to about 96%. Depending on the nature and the condition of the wood, suitably from about 10 sparing cycles each of from about 2 to about 15 minutes each can be employed.

Suitably the principal parameters of the present method are

| | |
|---|---|
| kiln temperature | from about 40° C. to about 100° C. |
| speed of air current | from about 0.1 to about 10 meters/sec |
| pressure | from about 0.5 bar to about 1.063 bar |
| duration heating | from about 3 to 18 hours |
| drying | from about 12 to about 71 hours |
| conditioning | from about 0 to about 12 hours |
| moisture content of wood | from about 50% at the beginning, and between about 6 and about 15% according to specification at the end of the process |

Generally the moisture content is between about 30% and about 8% during the progress of the process. The wood suitably containing of from about 18% to about 30% before the start of spraying in accordance with the present invention.

The dry wood obtained from the process within a few days has the same qualities as wood naturally dried for a number of years. Another result is that the resulting wood of low moisture content can be shaped, such as twisted, compressed, elongated, attenuated, defibered, etc, flexibly, without scobs. Therefore it can be formed almost like fresh wood.

The drawbacks of the prior art processes can be minimized or eliminated by use of the present invention:

(a) the process of the invention produces an effect like artificial aging reducing the changes in the shape and dimensions that arise because of the macroscopic features of wood, to a minimum in the course of drying;

(b) the changes in shape that take place during the known drying methods are avoided, therefore, the wood that is waiting for processing is not damaged by bending, warping, or splits;

(c) the dried wood is free of tension, therefore there is no loss of wood after processing, because all of the wood can be used;

(d) wood can be put to new uses, such as scobless shaping of wood that had been assumed could not be bent before, or flexible shaping without damages caused by temperature;

(e) the acceleration of growth and wood use in accordance with the present invention will avoid problems such as employing wood with a moisture content above the permissible limit, and reusing changes in shape, dimension, etc., thus further damages.

We claim:

1. A method for drying timber, which comprises drying substantially unseasoned timber in a kiln while spraying into the kiln at least once a mixture of nitric acid and an effective amount of an aqueous solution of an alkali earth metal salt, whereby the pectin of the wood fiber which normally blocks the evaporation of moisture from therebetween will become loosened to permit evaporation of the water content of the wood, and said alkali earth metal is incorporated in the wood fiber.

2. The timber processing method of claim 1, wherein said aqueous solution is a solution in distilled water.

3. The timber processing method of claim 2, wherein the timber is dried at from about 40° C. to about 100° C. to a minimum moisture content of 30% by mass.

4. The timber processing method of claim 3, wherein said mixture contains from about 42 to about 48% by mass (65%) nitric acid, from about 42 to about 48% by mass water, and from about 4 to about 16% by mass of said alkali earth metal salt.

5. The timber processing method of claim 4, wherein said alkali earth metal salt is calcium chloride.

6. The timber processing method of claim 2, wherein the concentration of the nitric acid is from about 65 to about 96% by mass.

7. The timber processing method of claim 2, wherein the spraying is commenced when the moisture content of the timber is between about 18 and about 30% by mass.

8. The timber processing method of claim 2, wherein the timber is dried after spraying, at a temperature between about 40° C. and about 100° C.

9. The timber processing method of claim 2, wherein spraying is carried out of a period of from about 2 to about 15 minutes depending on the nature of the wood of the timber.

10. The timber processing method of claim 9, wherein said spraying is carried out in from about 1 to about 10 spraying cycles.

* * * * *